US007311254B2

(12) United States Patent
Olsen

(10) Patent No.: US 7,311,254 B2
(45) Date of Patent: Dec. 25, 2007

(54) BOOKING STATION

(76) Inventor: Micheal Olsen, P.O. Box 141261, Grand Rapids, MI (US) 49514

( * ) Notice: Subject to any disclaimer, the term of this patent is extended or adjusted under 35 U.S.C. 154(b) by 378 days.

(21) Appl. No.: 11/142,811

(22) Filed: Jun. 1, 2005

(65) Prior Publication Data

US 2006/0284527 A1 Dec. 21, 2006

(51) Int. Cl.
*G06K 7/00* (2006.01)

(52) U.S. Cl. ..... 235/440; 312/237; 312/223.3

(58) Field of Classification Search ..... 235/440; 312/223.3, 237, 235.2, 198
See application file for complete search history.

(56) References Cited

U.S. PATENT DOCUMENTS 5,564,803 A * 10/1996 McDonald et al. ..... 315/215
5,746,489 A * 5/1998 Moon ..... 312/223.3
5,913,582 A * 6/1999 Coonan ..... 312/223.3
6,508,526 B2 * 1/2003 Reppas et al. ..... 312/237
7,029,079 B2 * 4/2006 Holt ..... 312/223.3
2002/0125798 A1 * 9/2002 Nielsen ..... 312/208.1
2003/0076014 A1 * 4/2003 Kelley et al. ..... 312/194
2003/0222548 A1 * 12/2003 Richardson et al. ..... 312/209
2005/0099102 A1 * 5/2005 Villarreal ..... 312/237
2006/0138915 A1 * 6/2006 Goldberg ..... 312/223.3

* cited by examiner

*Primary Examiner*—Daniel Hess
(74) *Attorney, Agent, or Firm*—Robert J. SayFie

(57) ABSTRACT

A booking station, comprising: a front, a back, a top, a bottom, a right side, and a left side, said front having a large front door that is hingedly connected to said front, said front also having a small front door that is hingedly connected to said front; a keyboard tray is substantially horizontally slidably mounted to a frame within the booking station upwardly from said large front door, said keyboard tray slidably mounted to said frame; a short front drawer is substantially horizontally slidably mounted to a frame within the booking station upwardly from said small front door, said top and said front having a scanner cut-out that is disposed upwardly from said short front drawer; and a substantially horizontally oriented scanner ledge is disposed upwardly from said short front drawer and begins substantially at the front extending rearwardly.

16 Claims, 3 Drawing Sheets

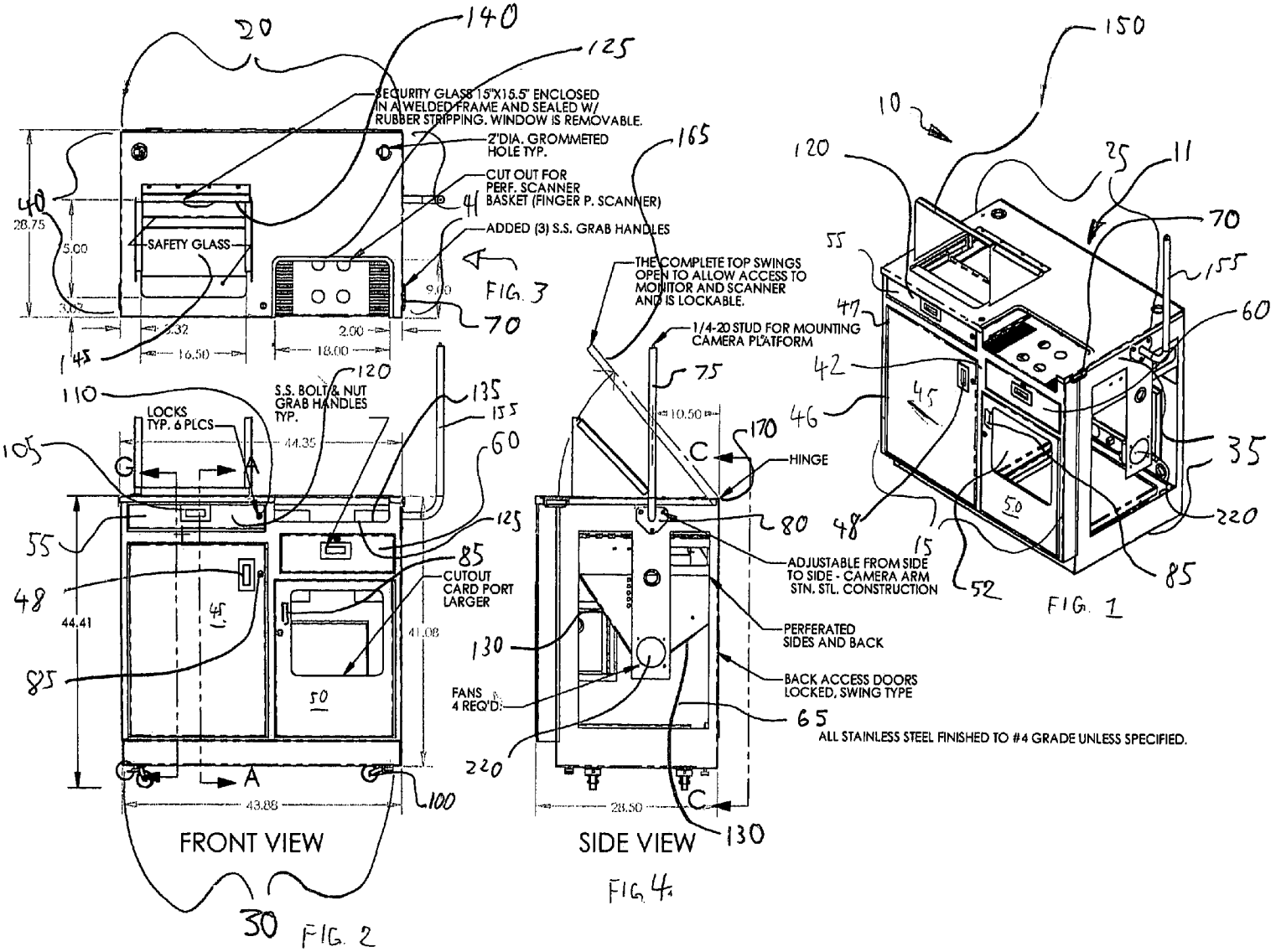
FIG. 1
SIDE VIEW
FIG. 4
FRONT VIEW
FIG. 2
FIG. 3
ALL STAINLESS STEEL FINISHED TO #4 GRADE UNLESS SPECIFIED.
SECURITY GLASS (1.5"X1.5.5" ENCLOSED IN A WELDED FRAME AND SEALED W/ RUBBER STRIPPING. WINDOW IS REMOVABLE.
2"DIA. GROMMETED HOLE TYP.
CUT OUT FOR PERF. SCANNER BASKET (FINGER P. SCANNER)
ADDED (3) S.S. GRAB HANDLES
THE COMPLETE TOP SWINGS OPEN TO ALLOW ACCESS TO MONITOR AND SCANNER AND IS LOCKABLE.
1/4-20 STUD FOR MOUNTING CAMERA PLATFORM
HINGE
ADJUSTABLE FROM SIDE TO SIDE - CAMERA ARM STN. STL. CONSTRUCTION
PERFERATED SIDES AND BACK
BACK ACCESS DOORS LOCKED, SWING TYPE
FANS 4 REQ'D.
CUTOUT CARD PORT LARGER
S.S. BOLT & NUT GRAB HANDLES TYP.
LOCKS TYP. 6 PLCS
SAFETY GLASS

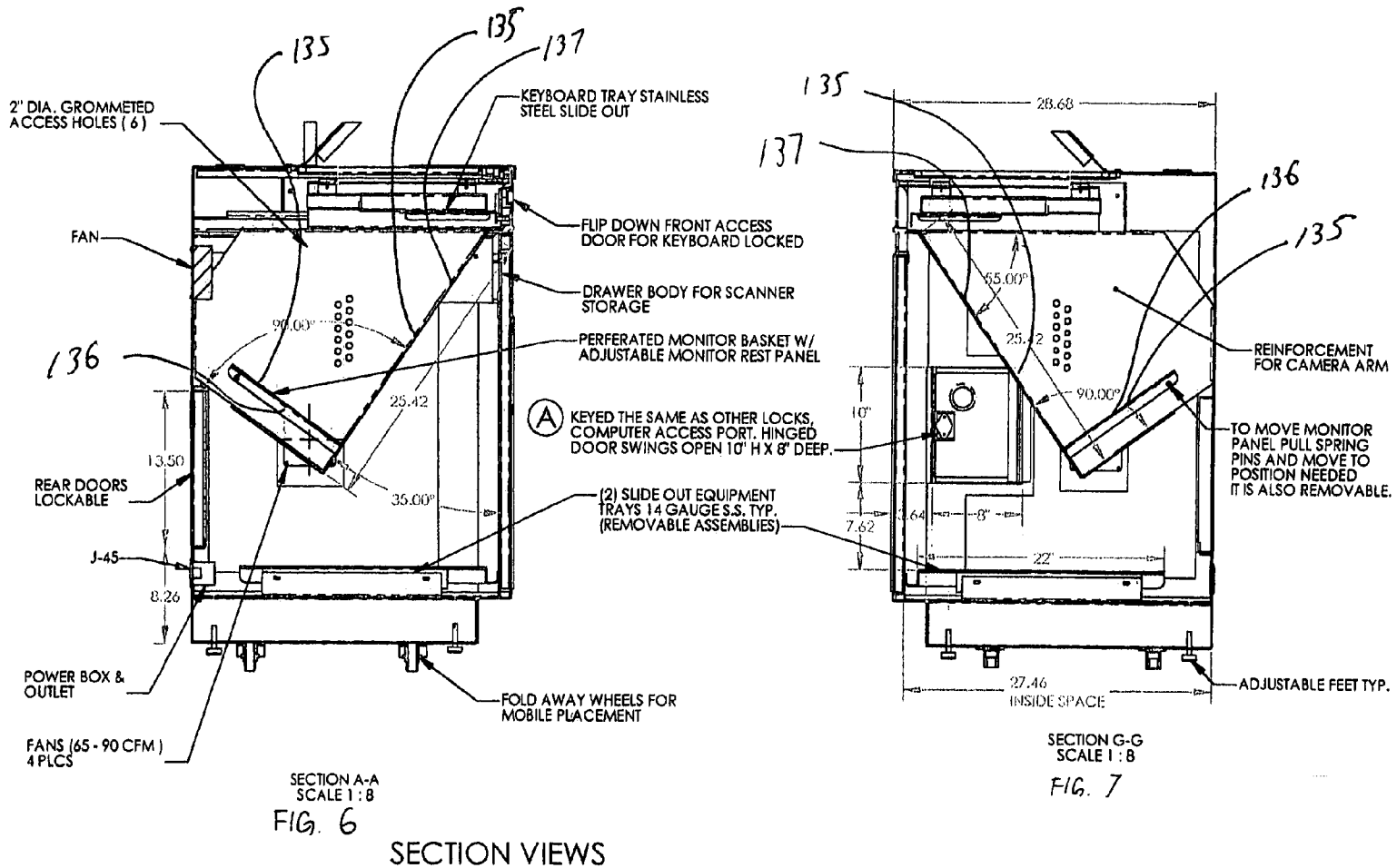
SECTION VIEWS

BOOKING STATION

BACKGROUND OF THE INVENTION

Law enforcement departments or personnel frequently are required to intake information from suspects, defendants, or criminals. Law enforcement departments or personnel must organize and process the information, which may include cross checks for criminal history or fingerprint analysis. The information may then used by the courts for plea agreements, trials, or sentencing of a defendant. This process is called booking of the defendant or suspect.

The booking process can be stressful because of the character or state of mind of the defendant or suspect. Sometimes several suspects or defendants are waiting to be booked at the same time due to multiple detainments or arrests within a small time period.

As can be seen, there is a need for a booking station that can quickly and efficiently enable a law enforcement officer to book a suspect quickly to avert danger and to process the suspect or defendant in a quick manner to enable the law enforcement officer to assume other responsibilities.

SUMMARY OF THE INVENTION

An booking station (10), comprising: a front (15), a back (20), a top (25), a bottom (30), a right side (35), and a left side (40), at least one of said front (15), said back (20), said top (25), said bottom (30), said right side (35), and said left side (40) having venting apertures (240); said front (15) having a large front door (45) that is hingedly connected to said front (15), said front (15) also having a small front door (50) that is hingedly connected to said front (15); a keyboard tray (55) is substantially horizontally slidably mounted to a frame within the booking station (10) upwardly from said large front door (45), said keyboard tray (55) slidably mounted to said frame to bias forwardly or rearwardly; a short front drawer (60) is substantially horizontally slidably mounted to a frame within the booking station (10) upwardly from said small front door (50), said short front drawer (60) slidably mounted to said frame to bias forwardly or rearwardly; said top (25) and said front (15) having a scanner cut-out (125) that is disposed upwardly from said short front drawer (60); a substantially horizontally oriented scanner ledge (30) is disposed upwardly from said short front drawer (60) and begins substantially at the front (15) extending rearwardly; a security top (165) that is hingedly secured to said top (25) near said top's (25) adjoinment with said back (20); a shield (150) removably attached to said top (25), said shield positioned above said monitor opening (140); a rolling member (100) that is foldable and lockable, said rolling member (100) rollably supporting the booking station (10); at least one of said front (15), said back (20), said top (25), said bottom (30), said right side (35), and said left side (40) having a fan aperture (200) to place forced air venting members such as electric fans to move air out of the booking station (10); a monitor frame (130) secured inside the booking station (10), said monitor frame (130) having an adjustable monitor rest panel (136) to adjust the position of the monitor relative to the monitor opening (140); a camera mounting arm (155) removably secured to at least one of said front (15), said back (20), said top (25), said bottom (30), said right side (35), and said left side (40); said back (20) having a rear hinged door (175) having a hinge that is oriented substantially vertical; and said large front door (45) is disposed leftwardly of said small front door (50).

Yet another aspect of the invention comprises a booking station (10), comprising: a front (15), a back (20), a top (25), a bottom (30), a right side (35), and a left side (40), at least one of said front (15), said back (20), said top (25), said bottom (30), said right side (35), and said left side (40) having venting apertures (240); said front (15) having a large front door (45) that is hingedly connected to said front (15), said front (15) also having a small front door (50) that is hingedly connected to said front (15); a keyboard tray (55) is substantially horizontally slidably mounted to a frame within the booking station (10) upwardly from said large front door (45), said keyboard tray (55) slidably mounted to said frame to bias forwardly or rearwardly; a short front drawer (60) is substantially horizontally slidably mounted to a frame within the booking station (10) upwardly from said small front door (50), said short front drawer (60) slidably mounted to said frame to bias forwardly or rearwardly; said top (25) and said front (15) having a scanner cut-out (125) that is disposed upwardly from said short front drawer (60); and a substantially horizontally oriented scanner ledge (30) is disposed upwardly from said short front drawer (60) and begins substantially at the front (15) extending rearwardly.

These and other features, aspects and advantages of the present invention will become better understood with reference to the following drawings, description and claims.

BRIEF DESCRIPTION OF THE DRAWINGS

FIG. 1 is a pictorial view of the booking station of the present invention.

FIG. 2 is a front view.

FIG. 3 is a top view.

FIG. 4 is a right side view.

FIG. 6 is a sectional view of line A-A of FIG. 2.

FIG. 7 is a sectional view of line G-G of FIG. 2.

DETAILED DESCRIPTION OF THE INVENTION

Figure 5:
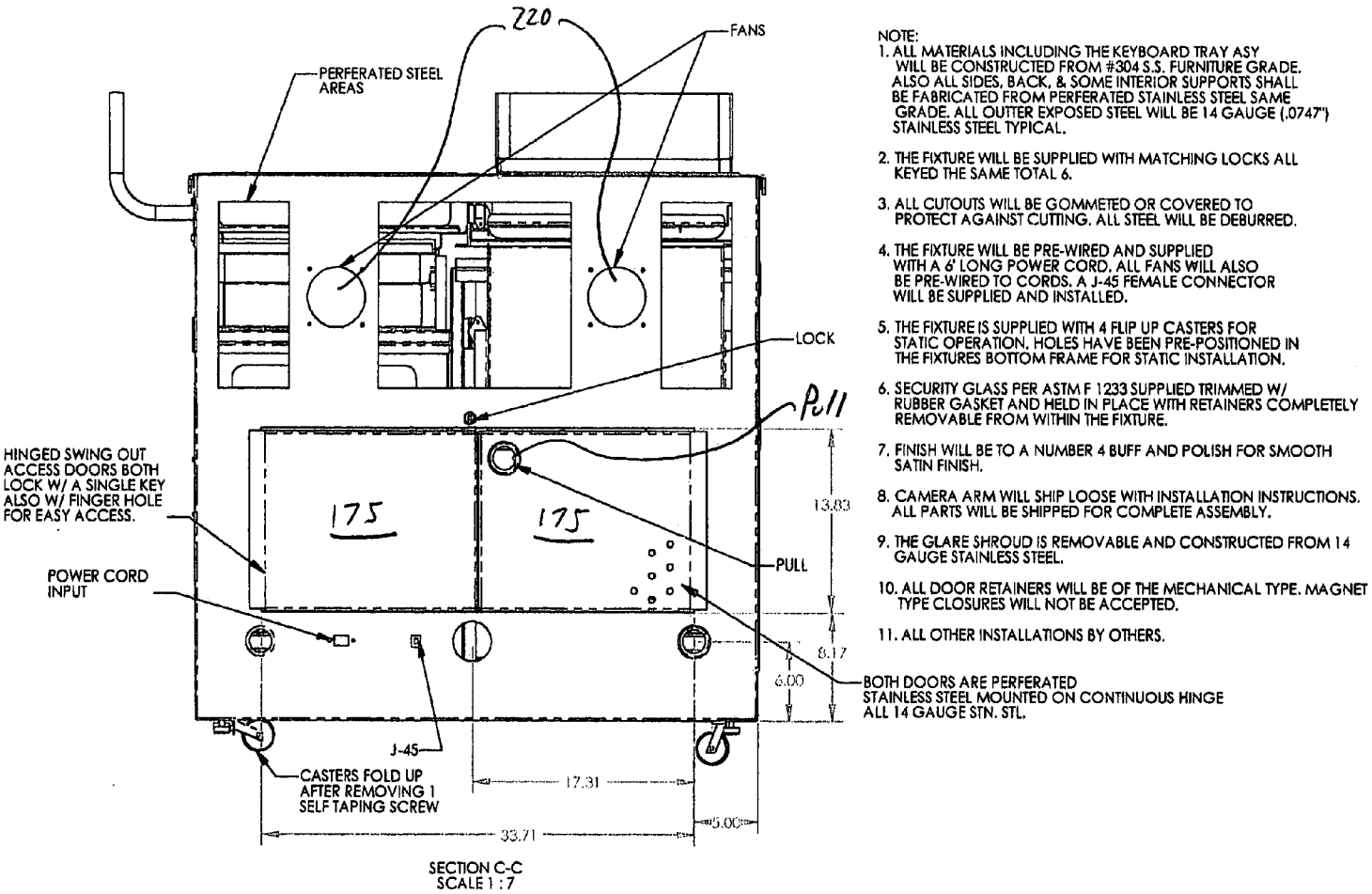
FIG. 5 is a back view.

The following detailed description is of the best currently contemplated modes of carrying out the invention. The description is not to e taken in a limiting sense, but is made merely for the purpose of illustrating the general principles of the invention, since the scope of the invention is best defined by the appended claims.

FIG. 1 illustrates a booking station 10 that has a shell 11. The shell is comprised of a front 15, a top 25, bottom 30 (illustrated in FIG. 2), a back 20 (illustrated in FIG. 3), a left side 40, and a right side 35, all secured to the adjacent respective component, and in an exemplar embodiment, having the general shape of a cube.

The front 15, top 25, back 20, left side 40, and right side 35 define an inside 65.

In an exemplar embodiment, the booking station 10 has a top width of about 44.35 inches, a bottom width of about 43.88 inches, a height (excluding casters 100) of about 41.08 inches, a top depth of about 28.75 inches, and a bottom depth of about 28.50 inches. With the casters 100 folded down for rolling, the height is about 44.41 inches.

The front 15 has a large front door 45 hingedly secured to said front panel 42 to open and close. In one exemplary embodiment the large front door 45 has a hinge edge 46, and a large front door hinge member 47 disposed on the large front door hinge edge 46, which allows the large front door 42 to pivot about a substantially vertically oriented hinge pivot axis, which is defined by the large front door hinge member 47 to hingedly secure the large front door 45 to the front 42. A large front door handle 48 is positioned near an upper substantially horizontally oriented edge of the large front door 45, and opposite from the large front door hinge edge 46. The large front door handle 46 is integral with the large front door 45 to open and close the large front door 45.

In an exemplar embodiment, the large front door hinge member 47 is disposed leftwardly of the large front door handle 46 to swing the large front door 45 to open leftwardly. Alternatively the large front door hinge member 47 may be disposed rightwardly of the large front door hinge edge 46, in which the large front door 45 would swing open rightwardly. In a further embodiment, the large front door hinge member 47 is disposed on the upper edge (no reference numeral), and the large front door handle is disposed on a bottom edge (no reference numeral), whereby the large front door 45 would swing upwardly. Or the large front door hinge member 47 is disposed on a bottom edge (no reference numeral) and the large front door handle 48 is disposed on the upper edge, so the large door would swing open downwardly, as is common in household stoves. A large front door lock 85 is secured to the large front door 45 to lock the door closed with respect to the front 15.

A small front door 50 is hingedly secured, via a small front door hinge member 90, to the front panel 42 so the small front door 50 can open and close. A small front door handle 85 is integral with the small front door 50 to easily pull the small front door 50 open. The orientation relationship between the small front door hinge member 90 and the small front door handle 85, can be of the variations as described for the large front door hinge member 47 and the large front door handle 48. For example the small front door hinge member 90 may be disposed leftwardly of the small front door handle 85, or vice versa, or one 90, 85 may be disposed upwardly or downwardly from the other 85, 90.

The small front door 50 has a cut-out 52. In one embodiment, the cut-out 52 is of rectangular shape as illustrated in FIG. 1. The cut-out 52 can be covered with transparent material such as glass or safety glass, so the cut-out can be used as a viewing window. Alternatively, the cut-out 52 can be covered with grating or a screen, which will still allow visual access, as glass, but will also allow ventilation.

FIG. 1 illustrates one exemplary embodiment, with the small front door 50 disposed rightwardly of the large front door 45. Alternatively, the small front door 50 can be disposed leftwardly of the large front door 45.

A keyboard tray 55 is slidably mounted within the booking station 10, above the large front door 45. The keyboard tray 55 has a flip down front access door 120 and a flip down front access door lock 110 to lock the drawer in a closed position, whereby the flip down front access door lock 110 locks the flip down front access door 120 to the front 15. The keyboard tray 55 may have a folding mouse pad support (not illustrated) that can fold inwardly immediately adjacent the keyboard tray 55 for storage.

The keyboard tray 55 can move forwardly or rearwardly relative to the front 15 via a glide member assembly (not shown); the glide member extends in the direction from the front 15 to the back 20.

The front 15 also has a storage drawer 60 disposed above the small front door 50. The storage drawer 60 is slidabley mounted via a glide member (not shown); to move forwardly or rearwardly relative to the front 15. The glide member extends in the direction from the front 15 to the back 20.

The top 25 has a scanner cut-out 125 disposed above the storage drawer 60. The scanner cut-out 125 enables a fingerprint scanner to be placed on a substantially horizontally oriented scanner surface 135. The scanner ledge 135 is disposed below the surface of the top 25 to allow the top of a fingerprint scanner to be substantially flush with the top 25. In one exemplar the scanner ledge 135 is about 3 to about 6¼ inches lower than the surface of the top 25. In one exemplar, the scanner cut-out 125 is about 18 inches wide, and extends about 9 inches rearwardly from the front 42. The scanner cut-out 125 can be positioned about two inches away from the right side 35, as illustrated in FIG. 3.

The top 25 also has a monitor opening 140 above the keyboard tray 55, rearwardly of the front 15. Within the booking station 10 is a monitor frame 130 to allow a computer monitor to be secured, or rested against. The monitor frame 130 can be adjusted or manufactured to be used to hold a flat screen monitor or a larger CRT monitor.

The monitor opening 140 can hold a removable transparent material 145, such as safety glass, so the monitor can be viewed from outside of the booking station 10. The monitor frame 130 can be an L-shaped surface (as shown in FIGS. 6 and 7) having an adjustable monitor rest panel 136, which the back of a computer monitor may rests against. The adjustable monitor panel 136 may be adjustable by any adjustable members, such as locking pins or spring pins (not illustrated). The bottom or base of the monitor may rest against the angled surface 137.

In one exemplar the transparent material is security glass 15"×15.5" enclosed is a welded frame and sealed with rubber stripping.

The monitor opening 140 can be a substantially rectangular shape, that can be positioned about 3.07 inches rearwardly from the front 42, and the monitor opening 140 can extend about 15 inches rearwardly, and it 140 can be about 16.50 inches wide, positioned about 3.32 inches leftwardly from the left side 40.

A shield 150 can be placed above the monitor opening 140 to reduce glare or to eliminate viewing of a monitor from the sides or back, as illustrated in FIG. 1.

A camera mounting arm 155 can be mounted to the right side 35, or alternatively the left side 40. The arm can extend upwardly to mount a camera or other accessory. The camera mounting arm 155 can be adjustable to mount not only on the sides 35, 40, but also on the back 20, front 15, or top 25.

A grab handle 70 can be disposed on the booking station 10 to move the booking station 10. In one exemplar, the grab handle 70 is secured to either the right side 35 or the left side 40 near the top 25. In another exemplar, there are two grab handles 70, one on the right side 35, the other on the left side 40, both near the top 25.

A grommetted hole 160 can be disposed on the top 25, and it 160 can be positioned in a corner near either the right side 35 and the back 20, or the left side 40 and the back 20. Alternatively, there can be two grommetted holes 160, one in each corner.

A security top 165 can be hingedly secured near the intersection of the surface on the top 25 and the back 20 via a security top hinge member 170. The security top can be of a size to completely cover the top 25. The security top 165 can also have a lock (not shown) to lock the security top 165, so as to prevent access to either the monitor opening 140 or the scanner cut-out 125. When the security top 165 is closed, the shield 150 can either be removed, or the shield 150 can be lowered into the booking station 10.

The right side 35 or left side 40 or the back 20 can have perforations.

FIG. 5 illustrates the back 20 and a rear hinged door 175. The rear hinged door 175 can be locked via the back door lock 180. The back door lock 180 may be disposed on the back 20 to lock the rear hinged door 175 in a closed position.

A pull 190 may be disposed on a rear hinged door 175.

A fan aperture 200 may be disposed on the back 20 or the left side 40, or the right side 35, or the front 15, or the top 25, or the bottom 30 (not illustrated). As illustrated in FIG. 5 the back 20 may have a fan aperture 200.

A fan 210 (not illustrated) may be disposed near a fan aperture 200.

The booking station can have a power cord input 210, as illustrated in FIG. 5. A wiring harness (not illustrated) can be electrically connected to the power cord input, to connect accessories such as a monitor, CPU, or fingerprint scanner.

Rolling members such as wheels or casters 100 can be secured to the bottom 20 to rollably support the booking station. The rolling members 100 can be folded or locked if desired.

The booking station may have fans 220, as illustrated in FIGS. 1, 4, and 5. Although the fans 220 are illustrated as being disposed on the back 20 and right side 35 and left side 40, a fan 220 may be disposed in the front 15, back 20, top 25, or bottom 30.

In one exemplar, all materials may be constructed of #304 S.S. furniture grade. Also, the front 15, back 20, top 25, bottom 30, right side 35, left side 40, and some interior supports or framing may be fabricated from perforated stainless steel, furniture grade. All outer exposed steel may be 14 gauge (0.0747") stainless steel typical.

In an exemplar, all cutouts may be grommetted or covered to protect against cutting, and all steel may be deburred.

The booking station 10 may be pre-wired and supplied with a 6' long power cord. Further, all fans 220 may be pre-wired to cords. Further, a J-34 female connector may be supplied and installed.

Any transparent material may be security glass per ASTM F 1233 supplied trimmed with rubber gasket and held in place with retainers completely removable from within the fixture.

The rolling members 100 may be flip-up casters 100 for static operation. The rolling members 100 may also be removed. The booking station 10 may be fastened to a floor.

In an exemplar, the finish will be to a number 4 buff and polished for smooth satin finish.

The shield or glare shroud 150 may be constructed from 14 gauge stainless steel.

In one exemplar door retainers are used to keep the doors closed. The door retainers may be mechanical.

The frame within the booking station (10) supports sliders and other conventional structures to support drawers, fans, door hinges, and other components that may be used in the present invention.

The front (15), back (20), bottom (30), top (25), right side (35), and left side (40) may be secured to each adjacent member by fasteners such as nuts and bolts, or by welding, or the members may be one unitary structure.

The hinge members 47, 95, 170, 175 may be a continuous hinge.

It should be understood, of course, that the foregoing relates to exemplary embodiments of the invention and that modifications may be made without departing from the spirit and scope of the invention as set forth in the following claims.

I claim:

1. A booking station (10), comprising:

a front, a back, a top, a bottom, a right side, and a left side, at least one of said front, said back, said top, said bottom, said right side, and said left side having venting apertures;

said front having a large front door that is hingedly connected to said front, said front also having a small front door that is hingedly connected to said front;

a keyboard tray is substantially horizontally slidably mounted to a frame within the booking station upwardly from said large front door, said keyboard tray slidably mounted to said frame to bias forwardly or rearwardly;

a short front drawer is substantially horizontally slidably mounted to a frame within the booking station upwardly from said small front door, said short front drawer slidably mounted to said frame to bias forwardly or rearwardly;

said top and said front having a scanner cut-out that is disposed upwardly from said short front drawer; and a substantially horizontally oriented scanner ledge is disposed upwardly from said short front drawer and begins substantially at the front extending rearwardly.

2. The booking station of claim 1, further comprising:

a security top that is hingedly secured to said top near said top's adjoinment with said back.

3. The booking station of claim 1, further comprising:

a shield removably attached to said top, said shield positioned above said monitor opening.

4. The booking station claim 1, further comprising:

a rolling member that is foldable and lockable, said rolling member rollably supporting the booking station.

5. The booking station of claim 1, wherein:

at least one of said front, said back, said top, said bottom, said right side, and said left side having an aperture for air displacement.

6. The booking station of claim 1, further comprising:

a monitor frame secured inside the booking station, said monitor frame having an adjustable monitor rest panel to adjust the position of the monitor relative to the monitor opening.

7. The booking station of claim 1, further comprising:

a camera mounting arm removably secured to at least one of said front, said back, said top, said bottom, said right side, and said left side.

8. The booking station of claim 1, further comprising:

said back having a rear hinged door having a hinge that is oriented substantially vertical.

9. The booking station of claim 1, wherein said large front door is disposed leftwardly of said small front door.

10. The booking station of claim 1, wherein said large front door is disposed rightwardly of said small front door.

11. The booking station of claim 1, further comprising a means to carry electrical power to components on top of or within the booking station.

12. The booking station of claim 11, wherein said means to carry is an electrical cord extending from the booking station that can be plugged into an electrical outlet, said electrical cord having a plug portion, said plug portion fixed to the booking station, said plug portion able to receive a plug to carry power to a device that rests on top of, or within the booking station.

13. The booking station of claim 1, wherein the booking station has a fan within the booking station.

14. The booking station of claim 1, further comprising a wiring harness to accept power cords that have at least a portion disposed within the booking station, said wiring harness also extending from the booking station and capable of plugging into a power outlet.

15. The booking station of claim 14, wherein said wiring harness extends from said back.

16. A booking station, comprising:

a front, a back, a top, a bottom, a right side, and a left side, at least one of said front, said back, said top, said bottom, said right side, and said left side having venting apertures;

said front having a large front door that is hingedly connected to said front, said front also having a small front door that is hingedly connected to said front;

a keyboard tray is substantially horizontally slidably mounted to a frame within the booking station upwardly from said large front door, said keyboard tray slidably mounted to said frame to bias forwardly or rearwardly;

a short front drawer is substantially horizontally slidably mounted to a frame within the booking station upwardly from said small front door, said short front drawer slidably mounted to said frame to bias forwardly or rearwardly;

said top and said front having a scanner cut-out that is disposed upwardly from said short front drawer;

a substantially horizontally oriented scanner ledge is disposed upwardly from said short front drawer and begins substantially at the front extending rearwardly;

a security top that is hingedly secured to said top near said top's adjoinment with said back;

a shield removably attached to said top, said shield positioned above said monitor opening;

a rolling member that is foldable and lockable, said rolling member rollably supporting the booking station;

at least one of said front, said back, said top, said bottom, said right side, and said left side having a fan aperture to place forced air venting members such as electric fans to move air out of the booking station;

a monitor frame secured inside the booking station, said monitor frame having an adjustable monitor rest panel to adjust the position of the monitor relative to the monitor opening;

a camera mounting arm removably secured to at least one of said front, said back, said top, said bottom, said right side, and said left side;

said back having a rear hinged door having a hinge that is oriented substantially vertical; and said large front door is disposed leftwardly of said small front door.

* * * * *